US006802284B2

(12) United States Patent
Hironaka et al.

(10) Patent No.: US 6,802,284 B2
(45) Date of Patent: Oct. 12, 2004

(54) FUEL INJECTION DEVICE AND AIR-FUEL MIXTURE GENERATING DEVICE PROVIDED WITH FUEL INJECTION DEVICE

(75) Inventors: Yoshiaki Hironaka, Saitama (JP); Michiyasu Kuwano, Tokyo (JP); Masao Iwata, Kanagawa (JP); Kiyoshige Enomoto, Kanagawa (JP)

(73) Assignees: Oppama Industry Co., Ltd., Kanagawa (JP); Kioritz Corporation, Tokyo (JP)

( * ) Notice: Subject to any disclaimer, the term of this patent is extended or adjusted under 35 U.S.C. 154(b) by 24 days.

(21) Appl. No.: 10/120,464

(22) Filed: Apr. 11, 2002

(65) Prior Publication Data

US 2002/0148419 A1 Oct. 17, 2002

(30) Foreign Application Priority Data

Apr. 13, 2001 (JP) ..... 2001-115829

(51) Int. Cl.[7] ..... F02B 33/04
(52) U.S. Cl. ..... 123/73 A; 123/478; 123/590
(58) Field of Search ..... 123/73 A, 478, 123/590, 472; 239/533.12

(56) References Cited

U.S. PATENT DOCUMENTS 4,105,004 A * 8/1978 Asai et al. ..... 123/470
5,586,524 A * 12/1996 Nonaka et al. ..... 123/73 A
5,725,158 A * 3/1998 Klaski et al. ..... 239/533.12
6,508,232 B2 * 1/2003 Sogawa ..... 123/478

FOREIGN PATENT DOCUMENTS

JP 4629576 8/1971
JP 4635455 12/1971
JP 482483 1/1973

* cited by examiner

*Primary Examiner*—Tony M. Argenbright
*Assistant Examiner*—Katrina B. Harris
(74) *Attorney, Agent, or Firm*—Baker Botts LLP

(57) ABSTRACT

A fuel injection device mounted on a main body of an air-fuel mixture generating device including an electromagnetic driving-type fuel injection valve for injecting, at predetermined times, fuel into an air-intake passageway of an intake system of an internal combustion engine, and a collision plate operationally coupled to the fuel injection valve adapted to be disposed in the air-intake passageway for enabling the injected fuel to collide therewith.

7 Claims, 5 Drawing Sheets

FUEL INJECTION DEVICE AND AIR-FUEL MIXTURE GENERATING DEVICE PROVIDED WITH FUEL INJECTION DEVICE

CROSS-REFERENCE TO RELATED APPLICATIONS

This application is based on Japanese Patent Application Ser. No. 115829/2001, filed Apr. 13, 2001, which is incorporated herein by reference for all purposes and from which priority is claimed.

BACKGROUND OF THE INVENTION

1. Technical Field of the Invention

The present invention relates to a fuel-injection device of electromagnetic driving type, for injecting fuel into an air-intake system of an internal combustion engine at predetermined times, and more particularly, to a fuel injection device adapted to be integrated, as fuel injection means, into an air-fuel mixture generating device equipped with a diaphragm-type fuel pump and designed to be employed in place of an ordinary carburetor.

2. Description of the Related Art

An air-intake system of a small air-cooled two-stroke gasoline engine of crankcase-precompression type (hereinafter, referred to simply as an internal combustion engine), designed to be mounted on a portable working machine such as a chain saw or a brush cutter, frequently employs, as an air-fuel mixture generating device, a floatless diaphragm-type carburetor. The carburetor is ordinarily equipped with a diaphragm-type fuel pump, which is designed to receive fuel and subsequently inject pressurized fuel in conformity with pressure changes (pulsating pressure) inside a crankcase of the internal combustion engine in order to ensure a stable fuel supply to the engine irrespective of the engine posture.

However, it is often difficult to precisely control the air/fuel ratio, i.e., a quantity of fuel relative to a quantity of the intake air, using a diaphragm-type carburetor, and to achieve sufficient fuel atomization and faithful response to the pulsating pressure, thereby making it difficult to effectively take measures for purifying the exhaust gas.

With a view to addressing these problems, an air-fuel mixture generating device, equipped with a fuel injection valve in addition to a diaphragm type fuel pump, has been recently proposed as an alternative to the aforementioned carburetor.

This air-fuel mixture generating device includes a main body similar to the carburetor, and a diaphragm disposed inside the main body. A pulsating pressure chamber, to which the pressure of the crankcase is transmitted, is provided on one side of the diaphragm, and a pump chamber for receiving fuel and then injecting fuel to a fuel passageway is provided on the other side of the diaphragm. The diaphragm is actuated (reciprocating movement) by the pressure changes (pulsating pressure) in the crankcase, resulting from the piston movement, i.e., a decrease in pressure as the piston is moved upward and an increase in pressure as the piston is moved downward. The pressurized fuel is thereby enabled to be fed from the pump chamber to the fuel passageway, and also the fuel inside the fuel passageway is enabled to be pressurized. Simultaneously, the aforementioned fuel injection valve is allowed to open at predetermined times (for example, at the moment of initiating the suction stroke) and remain open for a predetermined time period (for example, 1 to 3 milliseconds), depending on the operative conditions of the internal combustion engine to thereby enable the pressurized fuel in the fuel passageway to be injected into the intake system (for example, an intake passage portion located on a downstream side of a throttle valve) and be mixed with the received air, thereby producing an air-fuel mixture.

However, in such an air-fuel mixture-generating device, insufficient atomization of the fuel that has been injected from the fuel injection valve allows for a substantial portion of the injected fuel to adhere onto a sidewall of the intake passageway without being mixed with the air flowing through the passageway.

Additionally, if fuel atomization is insufficient, the air-fuel mixture becomes non-uniform, thereby badly affecting its combustibility in the internal combustion engine and, thus, the engine performance may deteriorate.

Moreover, even various modifications that have been suggested, such as increasing the supply pressure of fuel (fuel pressure) fed to the fuel injection valve, or decreasing a pore diameter of an injection port of the fuel injection valve, fail to achieve sufficient fuel atomization, and, thus, fail to overcome the aforementioned problems.

For example, in case where the pressurized fuel is fed to the fuel injection valve via a diaphragm-type fuel pump driven by the pressure changes (pulsating pressure) inside a crankcase of an internal combustion engine (e.g., when the aforementioned air-fuel mixture-generating device is employed), a delivery pressure effected by the diaphragm-type fuel pump is relatively low. Thus, when a pore diameter of an injection port of the fuel injection valve is decreased, the injection port is more likely to be clogged with dust, thereby obstructing the feeding of fuel. Accordingly, there exists a need in the art for a fuel injection device capable of enhancing fuel atomization and for an air-fuel mixture generating device equipped with such a fuel injection device, which can overcome the aforementioned disadvantages associated with the prior fuel-injection and air-fuel mixture-generating devices.

BRIEF SUMMARY OF THE INVENTION

An object of the present invention is to provide a fuel injection device which is capable of effectively enhancing fuel atomization as the fuel is injected from a fuel injection valve without increasing the fuel supply pressure fed to the fuel injection valve, or decreasing a pore diameter of an injection port of the fuel injection valve.

Another object of the present invention is to provide an air-fuel mixture generating device equipped with such a fuel injection device.

These and other objects of the present invention, which will become apparent with reference to the disclosure herein, are attained by the provision of a fuel injection device which includes an electromagnetic driving-type fuel injection valve for injecting fuel into an air-intake passageway of an intake system of an internal combustion engine at predetermined times, the fuel injection valve being provided with a collision plate adapted to be disposed in the air-intake passageway for enabling the injected fuel to collide therewith.

Preferably, the collision plate includes a reflecting surface, disposed downstream of the fuel injection valve, inclined so as to enable the fuel that has collided against the reflecting surface to reflect therefrom and diffuse along the direction of air flow running through the air-intake passageway of the intake system.

The reflecting surface may also be provided with restricting means such as a U-shaped groove for restricting the direction of reflection and diffusion of the fuel that collides with the reflecting surface, directed in line with the direction of the air flowing through the air-intake passageway, as well as in line with a direction intersecting orthogonally with a fuel-injecting direction of the fuel injection valve.

In another embodiment, an air-fuel mixture generating device according to the present invention comprises a main body, a diaphragm-type fuel pump disposed in the main body, a fuel passageway in the main body operationally coupled to the fuel pump for receiving and pressurizing the fuel injected from the fuel pump in conformity with pressure changes inside a crankcase of an internal combustion engine, a fuel injection device mounted on the main body and operationally coupled to the fuel passageway for receiving the pressurized fuel therefrom and injecting the pressurized fuel into an air-intake passageway of an air-intake system of the internal combustion engine, and the fuel injection device comprising a collision plate for colliding with the injected fuel.

According to the air-fuel mixture generating device of the present invention as constructed above, the fuel that is injected from the fuel injection device is forced to flow rod-like and to collide with a reflecting surface of the collision plate disposed in the air-intake passageway of the intake system, thereby enabling the fuel to be atomized and scattered as it is reflected from the reflecting surface. As a result, the atomization of fuel is promoted, so that most of the fuel injected from the fuel injection valve is permitted to diffuse into and be mixed with the air flowing through the air-intake passageway without being adhered onto the sidewall of the air-intake passageway. Therefore, it is now possible to uniformly mix the fuel and air, thereby enabling the combustibility of the air-fuel mixture to be enhanced in the internal combustion engine and hence improve the engine performance.

In yet another embodiment of the present invention, an air-cooled two-stroke gasoline engine of the crankcase precompression type having an air-intake passageway with a throttle valve having a downstream side disposed in the air-intake passageway, the air-intake passageway including a throat portion provided in a main body of an air-fuel mixture-generating device downstream of the throttle valve, wherein the improvement includes a fuel injection valve having a collision plate and a fuel injection port, the fuel injection valve being arranged at the throat portion provided on the downstream side of the throttle valve, the injecting direction of fuel from the injection port being orthogonal to a direction of the air flowing through the air-intake passageway.

As previously described, according to the fuel injection device of the present invention, since it is possible to effectively enhance the atomization of fuel being injected by the fuel injection valve without increasing the fuel supply pressure, or decreasing the pore diameter of the injection port of the fuel injection valve, the fuel injection device of the present invention is quite suited for being integrated, as fuel injection means, into an air-fuel mixture generating device wherein fuel is designed to be fed, under an enhanced pressure, to the fuel injection valve by means of a diaphragm-type fuel pump which is designed to be driven via the pressure changes (pulsating pressure) inside the crankcase of the internal combustion engine.

In accordance with the invention, the objects as described above have been met and the need in the art for a fuel-injection device and an air-fuel mixture generating device capable of effectively enhancing fuel atomization as the fuel is injected without increasing the fuel supply pressure or decreasing a pore diameter of an injection port of the fuel injection device, has been satisfied.

DETAILED DESCRIPTION OF THE INVENTION

Specific embodiments of the air-fuel mixture generating device and the fuel injection device according to the present invention will be explained with reference to the drawings.

Figure 1:
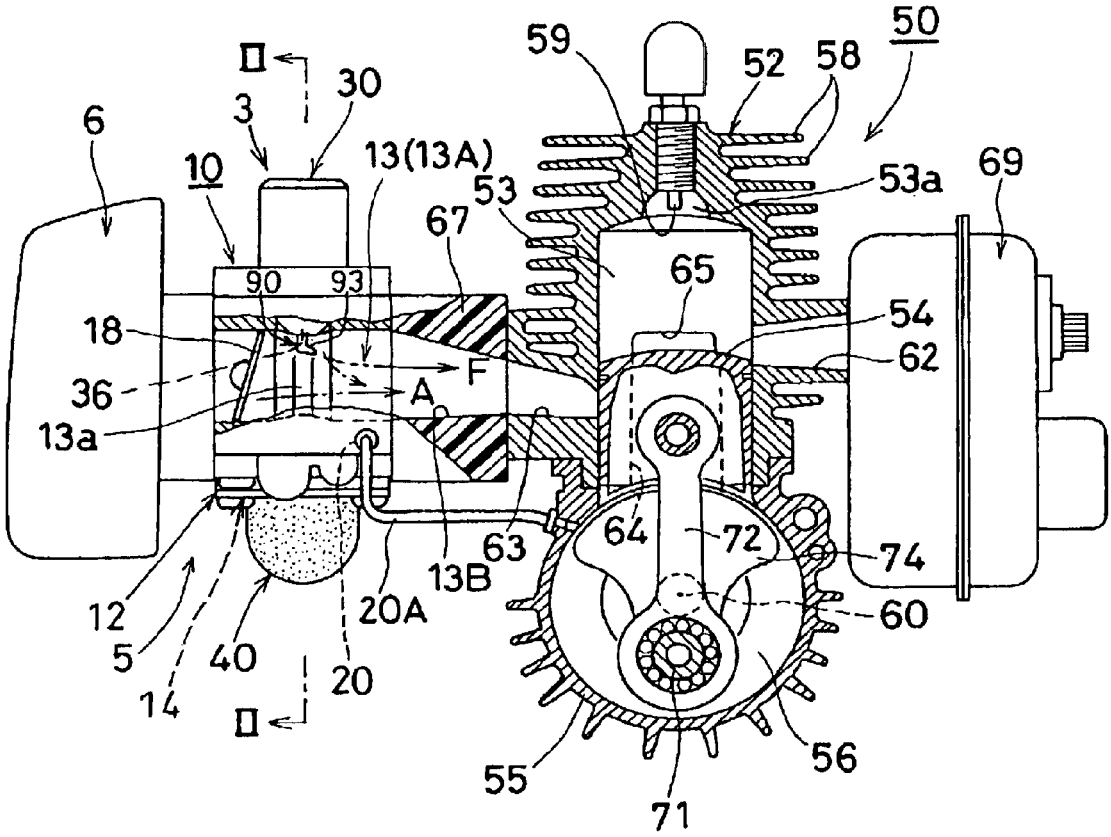
FIG. 1 is a longitudinal sectional view illustrating one embodiment of the air-fuel mixture generating device provided with a fuel injection device representing one embodiment of the present invention together with an internal combustion engine.
Figure 2:
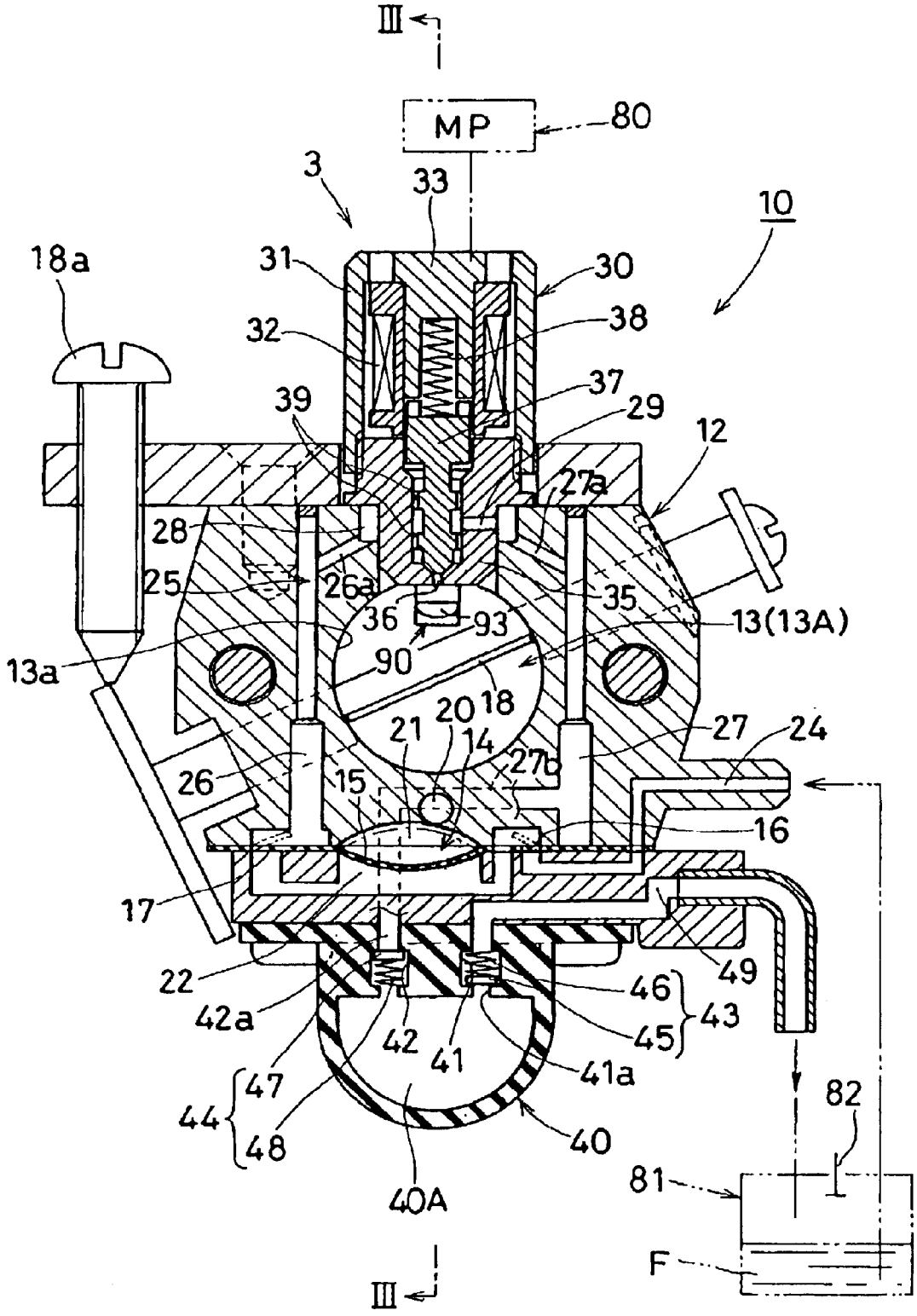
FIG. 2 is an enlarged cross-sectional view taken along the line II—II of FIG. 1.

FIG. 1 shows a longitudinal sectional view illustrating one embodiment of the air-fuel mixture generating device provided with a fuel injection device representing one embodiment of the present invention together with an internal combustion engine; and FIG. 2 shows an enlarged cross-sectional view taken along the line II—II of FIG. 1.

Referring to FIG. 1, the internal combustion engine 50 is formed of a small air-cooled two-stroke gasoline engine of the crankcase precompression type which is adapted to be mounted on a portable working machine, such as a brush cutter, etc. This internal combustion engine 50 comprises a cylinder 52 in which a piston 54 is slidably fitted enabling the piston 54 to be moved in the elevational direction, and a crankcase 55 connected with the lower end of the cylinder 52 and having a crank chamber 56 therein. The cylinder 52 is provided, on the outer circumferential wall thereof, with a large number of cooling fins 58 and also with an ignition plug 59 which is positioned at the top portion of the combustion actuating chamber 53 (combustion chamber 53*a*) located over the piston 54.

The crank chamber 56 has a short cylindrical shape and is hermetically closed. A crank shaft 60 is axially supported by the central portions of the right and left sidewalls of the crank chamber 56. The piston 54 is connected via a connecting rod 72 with a crank pin 71 of the crank shaft 60. A pair of crank webs 74 is fixed at the right and left ends of the crank pin 71 in such a manner that the connecting rod 72 is interposed between the pair of crank webs 74.

The cylinder 52 is provided, at an inner wall portion thereof, with an exhaust gas port 62 which is directed so as to orthogonally intersect with the longitudinal direction of the crank shaft 60, and at another inner wall portion thereof, with a suction port 63 which is located lower than and facing the exhaust gas port 62 (i.e. dislocated by an angle of 180 degrees). Furthermore, a pair of scavenging ports 65 forming a so-called Schnüirle type scavenging system is formed at the inner wall portions of the cylinder 52, which are located respectively at an intermediate portion between the exhaust gas port 62 and the suction port 63, i.e., both scavenging ports 65 facing each other and being spaced apart at an angle of 90 degrees from the exhaust gas port 62, as well as from the suction port 63. The scavenging ports 65 are respectively extended down to the lower portion of the cylinder 52 so as to be communicated with the top end (the downstream end) of the scavenging passageway 64 which is communicated with the crank chamber 56.

To one side of the cylinder 52, where the suction port 63 is located, there is attached, via a heat insulator 67, an intake system 5 forming an intake passageway 13, which is incorporated with the air-fuel mixture-generating device 10 according to one embodiment of the present invention and also with an air cleaner 6. To the other side of the cylinder 52, where the exhaust gas port 62 is located, there is attached a muffler 69 equipped with an exhaust gas purifying mechanism.

The intake passageway 13 includes a venturi passageway 13A passing through a portion of the air-fuel mixture-generating device 10, and a passageway 13B passing through a portion of the heat insulator 67. An automatic idling position reset type throttle valve 18 is disposed at the upstream side of the venturi passageway 13A formed in the air-fuel mixture-generating device 10.

The air-fuel mixture generating device 10 has a main body 12, which is similar in appearance to the conventional diaphragm-type carburetor and is equipped with a diaphragm-type fuel pump 14, which is designed to receive fuel F from a fuel tank 81 furnished with a breather 82, and to inject the fuel F into a fuel passageway 25 (26–29) in conformity with pressure changes (pulsating pressure) inside the crank chamber 56 of the internal combustion engine 50.

The air-fuel mixture generating device 10 also has a fuel injection valve 30 (which constitutes, as described below, a main portion of the fuel injection device 3 representing one embodiment of the present invention) for injecting, at predetermined times, the fuel F that has been introduced into the fuel passageway 25 and compressed to a predetermined magnitude, into the air-intake passageway 13 (the venturi passageway 13A) located on the downstream side of the throttle valve 18. The fuel injection valve 30 is disposed just over the venturi portion (throat portion) 13*a* of the venturi passageway 13A of the main body 12. A manual fuel pump 40 for filling the fuel passageway 25 with the fuel F at the time when the diaphragm-type fuel pump 14 is not actuated is disposed at a lower portion of the main body 12.

The diaphragm-type fuel pump 14 includes a diaphragm 15 disposed inside the main body 12 and made of a laminate which includes a synthetic sheet and a rubber layer, and a pulsating pressure chamber 21 which is formed over the top surface of the diaphragm 15 and to which the pulsating pressure of the crank chamber 56 is designed to be transmitted via a pulsating pressure passageway 20 (including a pipe 20A shown in FIG. 1) placed horizontally inside the main body 12, and a pulsating pressure pump chamber 22 which is formed below the rear surface of the diaphragm 15 and designed to receive fuel F from the fuel tank 81 through a fuel intake passageway 24 and to inject the fuel F into the fuel passageway 25.

There are further provided a flap valve 16 functioning as an intake valve which is formed at a portion of the diaphragm 15 located between the pulsating pressure pump chamber 22 and the fuel intake passageway portion 24, and a flap valve 17 functioning as an injection valve which is formed at a portion of the diaphragm 15 located between the pulsating pressure pump chamber 22 and the fuel passageway 25, both flap valves 16 and 17 being formed by respectively cutting a portion of the diaphragm 15 into a U-shape.

Figure 3:
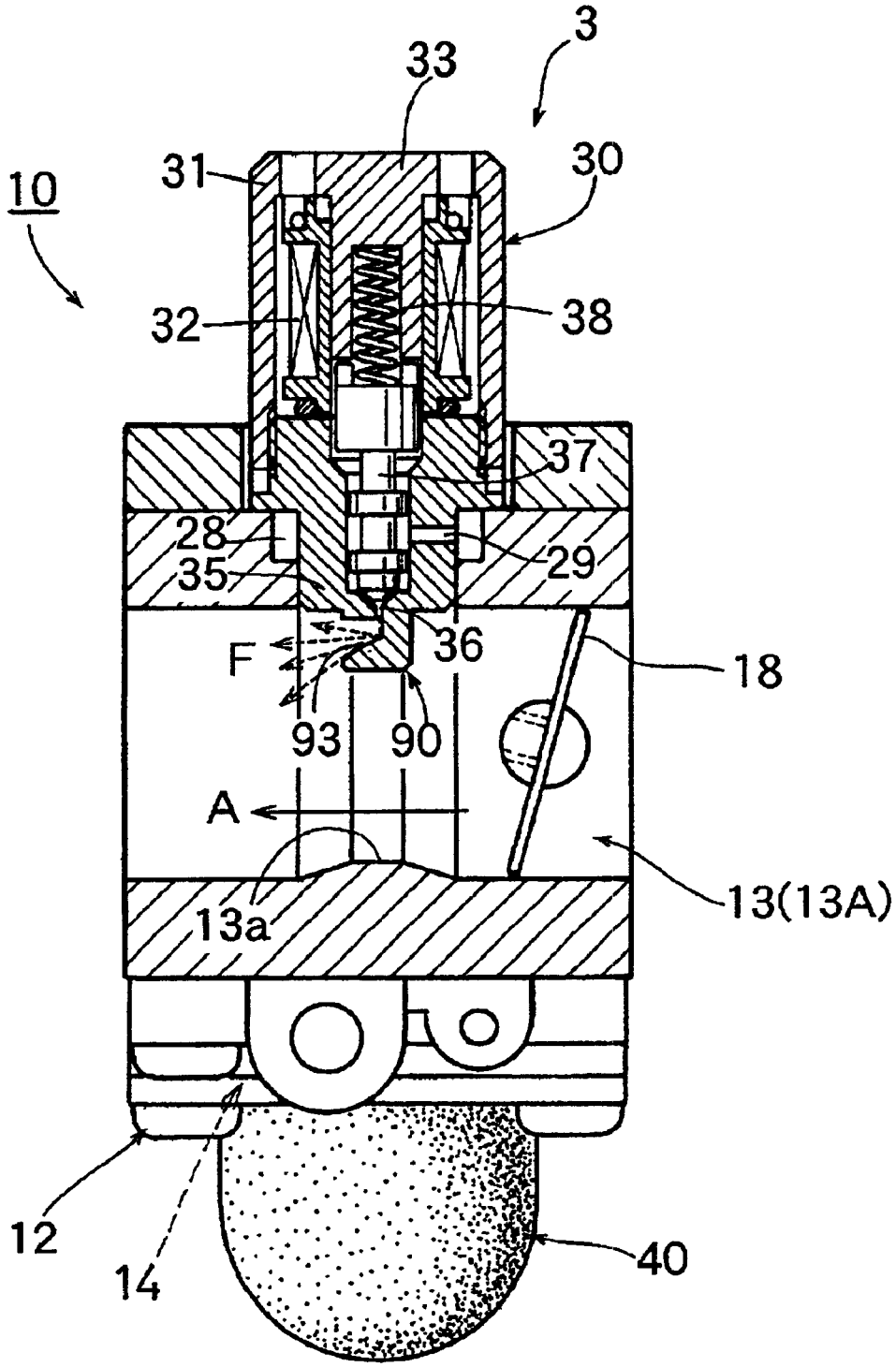
FIG. 3 is a cross-sectional view taken along the line III—III of FIG. 2.
Figure 4:
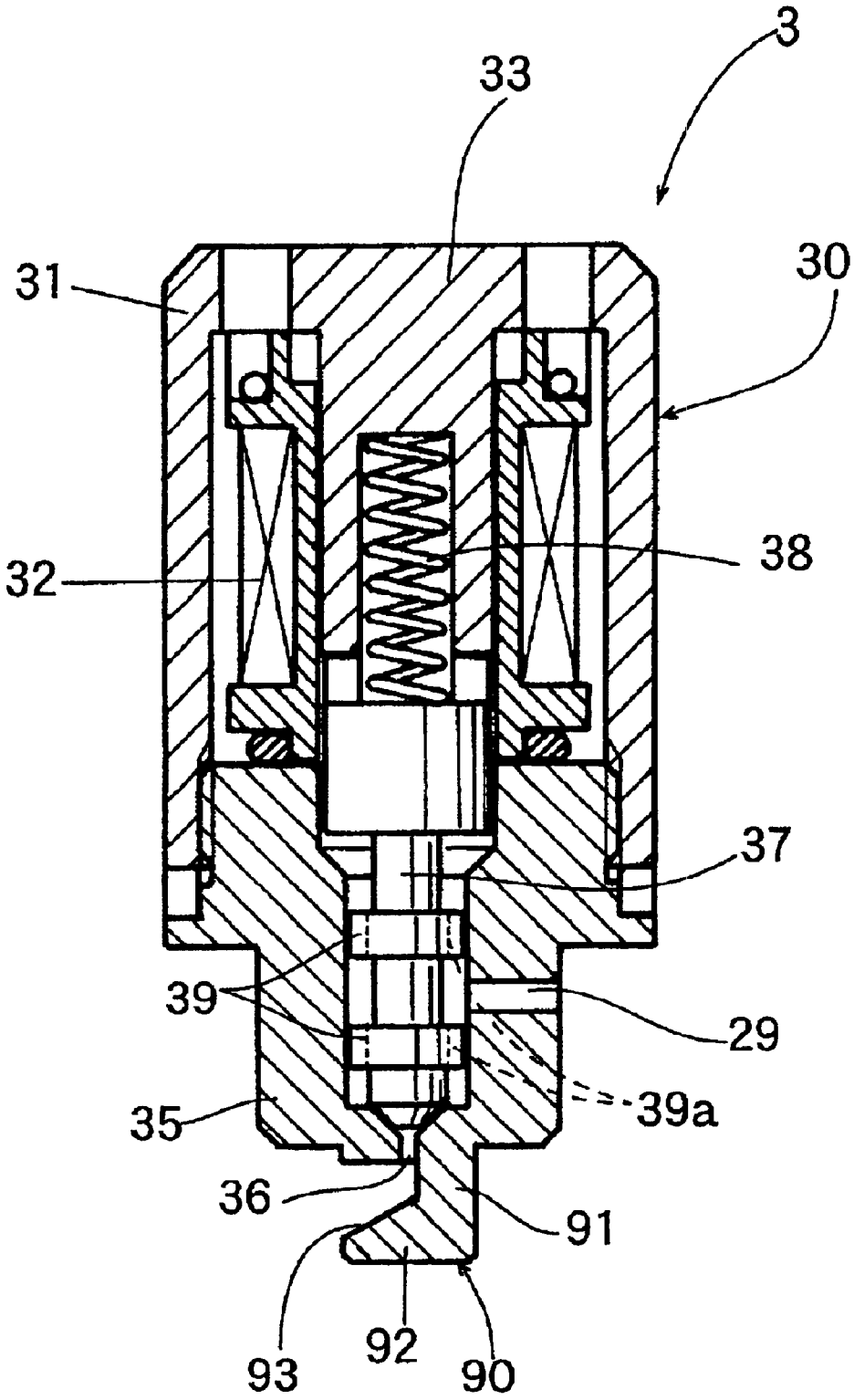
FIG. 4 is an enlarged cross-sectional view of the fuel injection valve shown in FIGS. 1 to 3.

As clearly seen from FIGS. 3 and 4 in addition to FIG. 2, the fuel injection valve 30 (which constitutes a main portion of the fuel injection device 3 representing one embodiment of the present invention) is of electromagnetic driving type and includes a cylindrical housing 31, a field coil 32, a stator (suction element) 33, a plunger (valve body) 37 having a conically shaped distal end (a lower end portion) and a couple of diametrically enlarged step portions 39 each having a longitudinal groove 39*a*, a valve seat 35 having an injection port 36 to be opened and closed by means of the plunger 37, and a compression coil spring 38 interposed between the stator 33 and the plunger 37. The injection port 36 is opened to the throat portion 13*a* of the venturi passageway 13A of the air-intake passageway 13, which is located on the downstream side of the throttle valve 18.

The fuel injection valve 30 is mounted perpendicularly to the air-intake passageway 13, so that the direction of fuel injection from the injection port 36 is orthogonally intersected with the direction of the air flowing through the air-intake passageway.

According to this embodiment, the collision plate 90 for enabling the fuel that has been injected from the fuel injection valve 30 to collide against it is disposed midway in the air-intake passageway 13.

Figure 5:
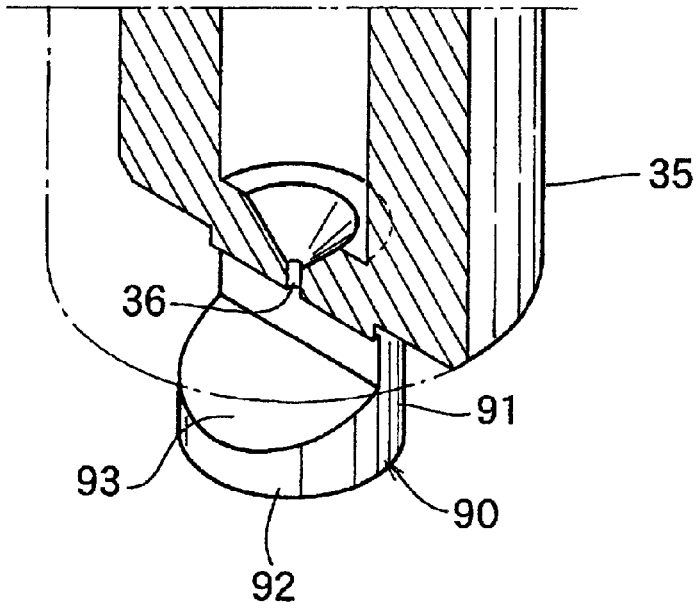
FIG. 5 is a partially cut enlarged perspective view illustrating in detail the collision plate of the fuel injection valve shown in FIGS. 1 to 4.

As clearly seen from FIG. 5 in addition to FIGS. 3 and 4, the collision plate 90 is formed integrally with the valve seat 35 and has a generally reverse-L-shaped configuration consisting of a vertically elongated portion 91 which is extended from the valve seat 35 toward the intake passageway 13, and a horizontally elongated portion 92 which is horizontally protruded from a lower portion of the vertically elongated portion 91 and extended along the direction of the air "A" flowing through the air-intake passageway 13, wherein the upper surface of the horizontally elongated portion 92 is constituted by a flat reflecting surface 93 which is inclined in such a manner that the portion thereof located closer to the downstream side of the air-intake passageway 13 is lowered. This reflecting surface 93 is located at a portion which is displaced away from the injection port 36 toward the downstream side thereof by a distance of about ⅕ of the diameter of the air-intake passageway 13, and is inclined by an angle of 45 degrees relative to the air-intake passageway 13 (the direction of air flow "A" passing therethrough).

According to this fuel injection valve 30, a pulse signal having a specific pulse width (duty ratio) corresponding to the operating conditions of the internal combustion engine 50 such as rotational speed, load, vibration, temperature, etc. is transmitted, with a predetermined timing (for example, at the moment of initiating the suction stroke), to the field coil 32 through an electronic controlling device 80 constituted by various kinds of sensor, microprocessors, etc. As a result, the field coil 32 is electrically magnetized to thereby pull up the plunger 37 against the urging force of the coil spring 38 for a period of time corresponding to the width of pulse (a time period of the electrical magnetization), thereby allowing the injection port 36 to open so as to adjust the quantity of fuel injection. It is also possible to adjust the quantity of fuel injection by feeding a predetermined number of pulses of constant breadth and at predetermined intervals on the occasion of suction strokes in conformity with the operating state of the internal combustion engine 50.

The fuel passageway 25 includes a first passageway 26 communicated via the flap valve 17 with the pulsating pressure pump chamber 22, an annular reserve well 28 formed around the valve seat 35 of the fuel injection valve 30 and communicated via a first communicating passage 26*a* with the first passageway 26 and via an injection valve side passage 29 and the plunger 37 with the injection port 36, a second passageway 27 communicated via a second communicating passage 27*a* with the reserve well 28, and a pump side passage 27*b* enabling the second passageway 27 to communicate via a pressure-adjusting valve (suction valve) 44 (to be explained hereinafter) with a manual pump chamber 40A of the manual fuel pump 40.

The manual fuel pump 40 is disposed because fuel is required to be manually introduced into the fuel passageway 25 at the time when the diaphragm type fuel pump 14 is not actuated, i.e. before the internal combustion is started. This manual fuel pump 40 is formed of an elastic ball made of an elastic material such as rubber and provided therein with the manual pump chamber 40A of semi-spherical configuration, a suction port 42 equipped with the above-mentioned pressure-adjusting valve 44, and an escape port 41 equipped with a release (escape) valve 43. The manual pump chamber 40A can be easily depressed as it is compressed with one's fingers and then, can be restored, by its own elastic force, to the original semi-spherical configuration as it is released.

The pressure-adjusting valve 44 disposed at the suction port 42 includes a disk-like valve body 47 for closing or opening the upper opening 42*a* of the suction port 42, and a compression coil spring 48 for urging the valve body 47 to close the upper opening 42*a* (upward direction). This pressure-adjusting valve 44 is designed such that it is capable of acting not only as a check valve (an intake valve) when the manual fuel pump 40 is actuated but also as a relief valve for allowing the fuel F inside the fuel passageway 25 to escape into the manual pump chamber 40A when the pressure of fuel F inside the fuel passageway 25 is increased so as to exceed a predetermined value.

The escape valve 43 disposed at the escape port 41 includes a disk-like valve body 45 for closing or opening the lower opening 41*a* of the escape port 41, and a compression coil spring 46 for urging the valve body 45 to close the lower opening 41*a* (downward direction). This escape valve 43 is designed such that it closes the lower opening 41*a* when the pressure inside the manual pump chamber 40A is less than a predetermined magnitude, and opens the lower opening 41*a* when the pressure inside the manual pump chamber 40A becomes higher than this predetermined magnitude to thereby allow the air and fuel F existing in the manual pump chamber 40A to escape via an escape passage 49 into the fuel tank 81.

The air-fuel mixture-generating device 10 constructed in this manner can be operated in the following manner. Before the diaphragm-type fuel pump 14 is actuated (i.e. before the internal combustion engine 50 is started), the pumping operation of the device 10, i.e., an operation wherein the manual pump chamber 40A of the manual fuel pump 40 is forced to depress by one's fingers and then, allowed to restore the original configuration thereof by releasing this pressing force is repeated several times. By this pumping operation of the device 10, the pressure-adjusting valve 44 disposed at the suction port 42 as well as the escape valve 43 disposed at the escape port 41 are enabled to function as a suction valve and an injection valve, respectively, thus achieving the pumping function of the device 10.

More specifically, when the manual pump chamber 40A is depressed, the inner volume of the manual pump chamber 40A is compressed, thereby enabling the pressure-adjusting valve 44 to close the suction port 42 (the upper opening 42*a*) and at the same time, enabling the escape valve 43 to open the escape port 41 (the lower opening 41*a*). As a result, the air A and fuel F existing in the manual pump chamber 40A are enabled to return through the escape port 41 and the escape passage 49 to the fuel tank 81. On the other hand, when the manual pump chamber 40A is released, it is allowed to return, by its own elastic force, to its original semi-spherical configuration, and at the same time, the escape valve 43 is actuated to close the escape port 41 (the lower opening 41*a*) and the pressure-adjusting valve 44 is actuated to open the suction port 42 (the upper opening 42*a*).

At this point, due to the suction force (negative pressure) that has been generated at the moment of the restoration of the manual pump chamber 40A, the fuel F in the fuel tank 81 is introduced, via the fuel intake passageway 24, the pulsating pressure pump chamber 22 and the flap valve 17, into the fuel passageway 25 (26–29), thereby filling the fuel F into the fuel passageway 25 (26–29), as well as into the region around the plunger 37 of the fuel injection valve 30.

When the internal combustion engine 50 is started by the manipulation of the recoil starter, etc., the fuel injection valve 30 is permitted to open with a predetermined timing (for example, at the moment of initiating the suction stroke) to thereby allow the fuel existing in the fuel passageway 25 to be injected from the injection port 36, provided at the choking portion 13*a* located on the downstream side of the throttle valve 18 of the air-intake passageway 13.

In this case, the fuel F that has been injected from the injection port 36 of the fuel injection valve 30 is forced to flow rod-like and to collide with the reflecting surface 93 of the collision plate 90 disposed midway in the air-intake passageway 13, thereby enabling the fuel to be atomized and scattered as it is reflected from the reflecting surface 93. As a result, the atomization of fuel is promoted, so that most of the fuel F injected from the fuel injection valve 30 is permitted to diffuse into and be mixed with the air "A" flowing through the intake passageway 13 without being adhered onto the sidewall of the air-intake passageway 13. As a result, the fuel F and the air "A" are enabled to be uniformly mixed. The resulting air-fuel mixture is then fed to the crank chamber 56 and to the combustion actuating chamber 53 of the internal combustion engine 50, thus allowing the air-fuel mixture to be ignited and explosively combusted by means of the ignition plug 59, thus achieving a self-sustaining normal rotational operation of the engine.

In the normal operation of the engine after the ignition, the pressure changes (pulsating pressure) inside the crank chamber 56, i.e. a decrease in pressure in the ascending stroke of the piston 54 and an increase in pressure in the descending stroke of the piston 54, are transmitted to the pulsating pressure chamber 21 of the diaphragm type fuel pump 14, thereby reciprocatively driving the diaphragm 15 (reciprocating movement). Due to the pumping action resulting from this vertical motion of the diaphragm 15, the fuel F is sucked into the pumping chamber 22 from the fuel tank 81, and then, fed from the pulsating pressure pump chamber 22 to the fuel passageway 25 (26–29) so as to be compressed therein during the period of time when the injection port 36 is closed.

During the normal operation of the engine, the fuel injection valve 30 is allowed to open at predetermined times (for example, at the moment of initiating the suction stroke) and remain open for a predetermined time period (for example, 1 to 3 milliseconds), depending on the operating conditions (such as the quantity of received air) of the internal combustion engine 50, to thereby enable the pressurized fuel F in the fuel passageway 25 to be injected from the injection port 36.

In this case, the fuel F that has been injected from the injection port 36 of the fuel injection valve 30 is forced to flow rod-like and to collide with the reflecting surface 93 of the collision plate 90, disposed midway in the air-intake passageway 13, thereby enabling the fuel to be atomized and scattered as it is reflected from the reflecting surface 93. As a result, the atomization of fuel is promoted, so that most of the fuel F injected from the fuel injection valve 30 is permitted to diffuse into and be mixed with the air "A" flowing through the air-intake passageway 13 without being adhered onto the sidewall of the air-intake passageway 13. As a result, the fuel F and the air "A" are enabled to be uniformly mixed, thereby enabling the combustibility of the air-fuel mixture to be enhanced in the engine 50 and thus improve the engine performance.

In this case, when the internal combustion engine 50 is placed into a state of high rotational speed, the quantity of fuel injected from the diaphragm-type fuel pump 14 is increased and hence the pressure of fuel F existing inside the fuel passageway 25 is also increased. However, when the pressure of fuel F existing inside the fuel passageway 25 is increased more than a predetermined value (for example, 0.05 MPa), the upper opening 42*a* is allowed to open by the pressure-adjusting valve 44 which is disposed at the intake port 42 of the manual fuel pump 40, thereby allowing the fuel F existing inside the fuel passageway 25 to escape into the manual pump chamber 40A of the manual fuel pump 40. Subsequently, when the pressure inside the manual pump chamber 40A becomes higher than a predetermined value, the lower opening 41*a* is allowed to open by the escape valve 43 which is disposed at the escape port 41 of the manual fuel pump 40, thereby allowing the fuel F existing inside the manual pump chamber 40A to return to the fuel tank 81.

It is possible in this manner to inhibit the pressure (maximum pressure) of fuel F existing inside the fuel passageway 25 from exceeding the aforementioned predetermined value. As a result, it is possible to prevent the occurrence of such a situation where the fuel F is excessively injected from the fuel injection valve 30 to thereby feed an excessively concentrated air-fuel mixture to the combustion actuating chamber 53 of the internal combustion engine 50.

As explained above, according to the fuel injection device 3 of this embodiment, the fuel F that has been injected from the injection port 36 of the fuel injection valve 30 is forced to flow rod-like and to collide with the reflecting surface 93 of the collision plate 90 disposed midway in the air-intake passageway 13, thereby enabling the fuel to be atomized and scattered as it is reflected from the reflecting surface 93. As a result, the atomization of fuel is promoted, so that most of the fuel F injected from the fuel injection valve 30 is permitted to diffuse into and be mixed with the air "A" flowing through the air-intake passageway 13 without being adhered onto the sidewall of the air-intake passageway 13. As a result, the fuel F and the air "A" are enabled to be uniformly mixed, thereby enabling the combustibility of the air-fuel mixture to be enhanced in the engine 50 and thus improve the engine performance.

As explained above, according to the fuel injection device 3 of this embodiment, since it is possible to effectively enhance the atomization of fuel on the occasion of injecting it from the fuel injection valve without increasing the fuel supply pressure fed to the fuel injection valve, or decreasing the pore diameter of the injection port of the fuel injection valve, the fuel injection device is quite suited for being integrated, as fuel injection means, into the air-fuel mixture-generating device 10 of the aforementioned structure wherein fuel is designed to be fed, under an enhanced pressure, to the fuel injection valve by means of a diaphragm-type fuel pump, which is designed to be driven by the pressure changes (pulsating pressure) inside the crankcase of the internal combustion engine.

Although the invention has been described herein by reference to specific embodiments thereof, it will be understood that such embodiments are susceptible of modification and variation without departing from the inventive concepts disclosed.

Figure 6:
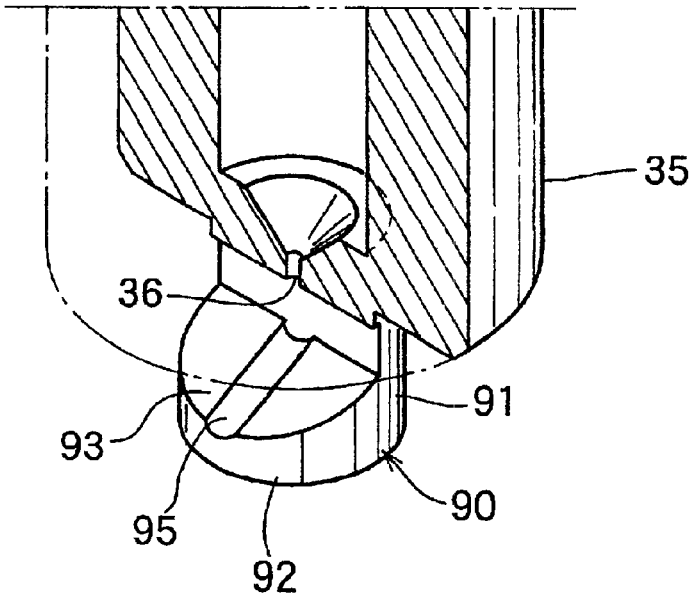
FIG. 6 is a partially cut enlarged perspective view illustrating in detail one modified example of the collision plate of the fuel injection valve shown in FIGS. 1 to 4.

For example, the reflecting surface 93 of the collision plate 90 may be modified in such a manner as shown in FIG. 6. Referring to FIG. 6, the reflecting surface 93 includes a U-shaped groove 95, which is semi-circular in cross-section, as a restricting means in the reflecting surface 93 for restricting the direction of reflection and diffusion of the fuel F that collides with the reflecting surface 93, directed in line with the direction of the air "A" flowing through the air-intake passageway 13 as well as in line with a direction intersecting orthogonally with the fuel injecting direction of the fuel injection valve 30.

As clear from the above explanation, in the air-fuel mixture generating device of the present invention, since the fuel that has been injected from the fuel injection valve is forced to flow rod-like and to collide against the reflecting surface of the collision plate which is disposed midway in the air-intake passageway, it is possible to enable the fuel to be effectively atomized and scattered as it is reflected from the reflecting surface. As a result, the atomization of fuel is promoted, so that most of the fuel injected from the fuel injection valve are permitted to diffuse into and be mixed with the air flowing through the air-intake passageway without being adhered onto the sidewall of the air-intake passageway. Therefore, it is now possible to uniformly mix the fuel and air, thereby enabling the combustibility of the air-fuel mixture to be enhanced in the internal combustion engine and thus improve the engine performance.

Furthermore, according to the fuel injection device of the present invention, since it is possible to effectively enhance the atomization of fuel as it is injected from the fuel injection valve without increasing the fuel supply pressure fed to the fuel injection valve, or decreasing the pore diameter of the injection port of the fuel injection valve, the fuel injection device of the present invention is quite suited for being integrated, as fuel injection means, into an air-fuel mixture-generating device wherein fuel is designed to be fed, under an enhanced pressure, to the fuel injection valve by means of a diaphragm-type fuel pump which is designed to be driven via the pressure changes (pulsating pressure) inside the crankcase of the internal combustion engine.

All such modifications, therefore, are intended to be included within the spirit and scope of the appended claims.

What is claimed is:

1. An air-fuel mixture generating device, comprising:

(a) a main body;

(b) a diaphragm fuel pump disposed in said main body;

(c) a fuel passageway in the main body operationally coupled to said fuel pump for receiving and pressurizing fuel injected from the fuel pump in conformity with pressure changes inside a crankcase of an internal combustion engine;

(d) a fuel injection device mounted on said main body and operationally coupled to said fuel passageway for receiving the pressurized fuel therefrom and injecting said pressurized fuel into an air-intake passageway of an intake system of the internal combustion engine; and (e) said fuel injection device comprising a collision plate for colliding with the injected fuel.

2. The air-fuel mixture generating device of claim 1, wherein said fuel injection device comprises an electromagnetic driving-fuel injection valve for injecting fuel into the air-intake passageway of the intake system at predetermined times.

3. The air-fuel mixture generating device of claim 2, wherein said collision plate comprises a reflecting surface for enabling the injected fuel to be atomized and scattered in the air-intake passageway.

4. The air-fuel mixture generating device of claim 3, wherein said reflecting surface is inclined so as to enable the collided fuel to reflect therefrom and diffuse along a direction of air flowing trough the air-intake passageway of the intake system.

5. The air-fuel mixture generating device of claim 4, wherein said reflecting surface comprises restricting means for restricting a direction of reflection and diffusion of the collided fuel, said restricting means being directed in line with a direction of the air flowing through the air-intake passageway as well as in line with a direction intersecting orthogonally with a fuel-injecting direction of said fuel injection valve.

6. The air-fuel mixture generating device of claim 5, wherein said restricting means is a U-shaped groove formed in said reflecting surface.

7. An air cooled two-stroke gasoline engine of the crankcase precompression having an air-intake passageway and a throttle valve having a downstream side disposed in the air-intake passageway, the air-intake passageway including a throat portion provided in a main body of an air-fuel mixture generating device downstream of the throttle valve, wherein the improvement comprises a fuel injection valve having a collision plate and a fuel injection port, the fuel injection valve being arranged at the throat portion provided on the downstream side of the throttle valve, the injecting direction of fuel from said injection port being orthogonal to a direction of the air flowing through the air-intake passageway.

* * * * *